US010540949B2

(12) United States Patent
Ekuni et al.

(10) Patent No.: US 10,540,949 B2
(45) Date of Patent: Jan. 21, 2020

(54) MUSICAL INSTRUMENT CAPABLE OF PRODUCING ADDITIONAL VIBRATION SOUND AND METHOD THEREFOR

(71) Applicant: YAMAHA CORPORATION, Hamamatsu-shi (JP)

(72) Inventors: Shingo Ekuni, Calabasas, CA (US); Tom Schröer, Havixbeck-Hohenholte (DE)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 16/039,699

(22) Filed: Jul. 19, 2018

(65) Prior Publication Data

US 2018/0330703 A1 Nov. 15, 2018

Related U.S. Application Data

(63) Continuation of application No. PCT/JP2016/088104, filed on Dec. 21, 2016.

(30) Foreign Application Priority Data

Jan. 20, 2016 (JP) ..... 2016-008884

(51) Int. Cl.
*G10H 1/02* (2006.01)
*G10H 3/00* (2006.01)
(Continued)

(52) U.S. Cl.
CPC ..... *G10H 1/0535* (2013.01); *G10H 1/0091* (2013.01); *G10H 3/186* (2013.01)

(58) Field of Classification Search
CPC ..... G10H 3/26; G10H 3/18; G10H 2210/201; G10H 2210/221; G10H 3/181;
(Continued)

(56) References Cited

U.S. PATENT DOCUMENTS 9,245,511 B1 1/2016 Ando
2006/0000347 A1* 1/2006 Preece ..... G10H 1/36 84/741

(Continued)

FOREIGN PATENT DOCUMENTS

EP 1956585 A2 8/2008
JP H04500735 A 2/1992

(Continued)

OTHER PUBLICATIONS

International Search Report issued in International Application No. PCT/JP2016/088104 dated Mar. 14, 2017. English translation provided.

(Continued)

*Primary Examiner* — Marlon T Fletcher
(74) *Attorney, Agent, or Firm* — Rossi. Kimms & McDowell LLP

(57) ABSTRACT

The musical instrument includes: a pickup that acquires an electric sound signal corresponding to a sound performed on the musical instrument; effector circuitry that imparts an effect to the acquired electric sound signal; a vibrator that produces mechanical vibration corresponding to the effect-imparted sound signal; and a transmission device that transmits the mechanical vibration, produced by the vibrator, to the body of the musical instrument with a characteristic having a fundamental frequency region of the musical instrument suppressed. The electric sound signal corresponding to the performed sound is imparted with an effect, the vibrator is driven by the effect-imparted sound signal, and a mechanical vibration sound is generated from the body of the musical instrument. The thus-generated mechanical vibration sound is audibly generated from the body as a vibration sound additional to the performed sound, which
(Continued)

allows a user to experience a performance feeling that has never existed before.

16 Claims, 4 Drawing Sheets

(51) Int. Cl.
*G10H 1/053* (2006.01)
*G10H 1/00* (2006.01)
*G10H 3/18* (2006.01)

(58) Field of Classification Search
CPC .... G10H 3/186; G10H 2210/155; G10H 3/00; H04R 25/604; H04R 25/48; H04R 17/00; H04R 2499/15; G10D 3/04; G10D 3/143; G10D 1/085; G10G 7/02; G10K 9/122; G10K 2210/3026
See application file for complete search history.

(56) References Cited

U.S. PATENT DOCUMENTS

2013/0145922 A1* 6/2013 Shinoda ..... G10H 1/125 84/604
2013/0205978 A1* 8/2013 Yamabata ..... G10H 1/18 84/616
2014/0080594 A1 3/2014 Osada
2014/0202320 A1 7/2014 White
2014/0224099 A1* 8/2014 Webman ..... G10H 3/18 84/630
2015/0356960 A1* 12/2015 Webman ..... G10H 3/18 84/630
2016/0140941 A1* 5/2016 Kobayashi ..... G10D 3/04 84/3

FOREIGN PATENT DOCUMENTS

JP 2002539479 A 11/2002
JP 2003295865 A 10/2003
JP 2005122099 A 5/2005
JP 2014057809 A 4/2014
JP 2014066808 A 4/2014
JP 5676044 B1 2/2015
WO 0054250 A1 9/2000
WO 2012085349 A1 6/2012
WO 2013089239 A1 6/2013
WO 2016152219 A1 9/2016

OTHER PUBLICATIONS

Written Opinion issued in International Application No. PCT/JP2016/088104 dated Mar. 14, 2017.
Eishin Denki Kabushiki Kaisha. "Attachable Speaker" pp. 1-4. Web. http://eishindenki.com/index.php?data=./data15/. Partial English translation provided.
English translation of Written Opinion issued in Intl. Appln. No. PCT/JP2016/088104 dated Mar. 14, 2017.
International Preliminary Report on Patentability issued in Intl. Appln. No. PCT/JP2016/088104 dated Aug. 2, 2018. English translation provided.
Extended European Search Report issued in European Appln. No. 16886520.2 dated Aug. 30, 2019.

* cited by examiner

MUSICAL INSTRUMENT CAPABLE OF PRODUCING ADDITIONAL VIBRATION SOUND AND METHOD THEREFOR

BACKGROUND

The present invention relates generally to a musical instrument capable of producing or generating an additional vibration sound and a method for adding an additional vibration sound in a musical instrument, and more particularly the present invention relates to a technique for generating an additional vibration sound using a vibrator (electric-to-vibration transducer) to impart mechanical vibration to the body of a musical instrument (such as an acoustic guitar) and thereby generate an additional vibration sound.

A technique has heretofore been known according to which a voice-coil type actuator (speaker) is mounted to the soundboard of a piano, and physical vibration of the actuator is transmitted to the soundboard so that a mechanical vibration sound is generated from the soundboard (see, for example, Patent Literatures 1 and 2 identified below). Further, according to this conventionally-known technique, a sound source of an electric waveform signal to be supplied to the actuator is an electronic sound source, not a live sound played or performed on a piano. Namely, this conventionally-known technique is arranged in such a manner that turning-on of any one of the keys of the piano is detected, an electric waveform signal having a pitch corresponding to the turned-on key is generated from the electronic sound source and then the actuator is driven by the electric waveform signal. Thus, with this conventionally-known technique, there is no need to take into consideration problems of howling etc. caused by a live performed sound being fed back to a loop of the mechanical vibration sound generated by the actuator.

Further, Patent Literature 3 identified below discloses electrically picking up string vibration in a stringed instrument, such as a guitar, amplifying the picked-up string vibration signal, and then causing a mechanical vibration sound to be generated from the body of the musical instrument by driving an actuator with the string vibration signal. However, with the technique disclosed in Patent Literature 3, a problem of howling would occur by the string vibration signal, generated by a performance of the stringed instrument, being fed back to a loop of the mechanical vibration sound generated by the actuator. The technique disclosed in Patent Literature 3 does not at all take such a howling problem into consideration. Patent literature 3 also discloses performing signal processing on the picked-up string vibration signal for varying the musical interval (or pitch) of the string vibration signal and then driving the actuator with the thus-processed electric vibration signal so that a mechanical vibration sound with controlled tonality is generated from the body of the musical instrument. However, because the signal processing disclosed in Patent Literature 3 is designed primarily to cause a sound of different tonality (musical interval or pitch) from the string vibration sound to be generated through vibration of the body of the instrument, there is no need to take the problem of howling into consideration, and thus, Patent Literature 3 does not at all teach a solution to the howling.

Furthermore, ceramic speakers have been known as compact vibrator devices, and it has been known to mount such a ceramic speaker on a hard object or body and generate a vibration sound by vibrating the hard body (see, for example, Non-patent Literature 1 identified below). As far as the Applicant knows, there has been no precedent example where such a ceramic speaker is used as a mechanical vibration source for a musical instrument. However, considering the prior techniques as disclosed in Patent Literatures 1 and 2 that are applied to a piano, the compact vibrator devices, such as the ceramic speakers, are deemed to be suitable for use in a relatively small-sized musical instrument like a guitar. What is more, Patent Literature 4 identified below discloses a game device where a first sound signal having been subjected to effect processing and a second sound signal having not been subjected to effect processing are generated and sounded in parallel, on the basis of same sound data, to enhance an acoustic effect. However, Patent Literature 4 discloses nothing about applying such effect processing to addition of a mechanical vibration sound in a musical instrument.

Patent Literature 1: Japanese Patent Application Laid-open Publication No. HEI-4-500735

Patent Literature 2: International Publication No. WO2013/089239

Patent Literature 3: Japanese Patent Application Laid-open Publication No. 2003-295865

Patent Literature 4: Japanese Patent Application Laid-open Publication No. 2014-057809

Non-patent Literature 1: http://eishindenki.com/index.php?data=./data15/

However, using a dedicated electronic sound source, like that shown in Patent Literature 1 or 2, as a source of an electric waveform signal to be supplied to the vibrator device would increase the necessary cost and thus is not preferable in cases where it is intended to provide low-cost equipment. Further, there would be presented another disadvantage that subtleties of the actual performed sound of the musical instrument cannot be reflected in the mechanical vibration sound. Thus, detecting a live performed sound of a musical instrument, such as a guitar, by means of a pickup and using the thus-detected live performed sound as a source of an electric waveform signal to be supplied to a vibrator device is advantageous not only in terms of the necessary cost but also for the purpose of allowing the subtleties of the actual performed sound of the musical instrument to be reflected in the mechanical vibration sound. However, if such an approach is employed, there would occur problems, such as howling, caused by the performed sound of the musical instrument being fed back to a loop of the mechanical vibration sound generated by the vibrator device.

SUMMARY OF INVENTION

In view of the foregoing prior art problems, it is an object of the present invention to provide a musical instrument and method which are capable of generating an additional vibration sound, and which can be implemented at low cost and can not only permit reflection, in the additional vibration sound, of subtleties of an actual performed sound of the musical instrument but also solve problems, such as howling.

A musical instrument of the present invention comprises: a pickup that acquires an electric sound signal corresponding to a performed sound of the musical instrument; an effectoreffector circuitry that imparts an effect to the electric sound signal acquired by the pickup; a vibrator mounted to the body of the musical instrument for producing mechanical vibration corresponding to the sound signal imparted with the effect; a transmission device constructed to transmit the mechanical vibration, produced by the vibrator, to the body of the musical instrument with a characteristic having a fundamental frequency region of the musical instrument appropriately suppressed.

According to the present invention, an effect is imparted to the electric sound signal corresponding to the performed sound of the musical instrument, the vibrator is driven by the effected-imparted sound signal to produce mechanical vibration so that a mechanical vibration sound corresponding to the produced mechanical vibration is generated from the body of the musical instrument. More specifically, the thus-generated mechanical vibration sound is audibly generated from the body as a vibration sound additional to the performed sound, which allows a user to experience a performance feeling that has never existed before. Because the electric sound signal corresponding to the performed sound of the musical instrument is used as a sound source for the vibrator in the present invention, the present invention requires no dedicated electronic sound source and thus can be implemented at low cost. Further, a mechanical vibration sound having subtleties of an actual performed sound of the musical instrument reflected therein can be generated from the body of the musical instrument. Moreover, because the above-mentioned mechanical vibration produced by the vibrator is transmitted to the body of the musical instrument with the characteristic having the fundamental frequency region of the musical instrument appropriately suppressed, the vibration sound based on the mechanical vibration produced by the vibrator has the characteristic having the fundamental frequency region of the musical instrument appropriately suppressed as compared to the performed sound mainly having the fundamental frequency region, and thus, it is possible to prevent unwanted howling. What is more, because the additional vibration sound is generated, in addition to the performed sound of the musical instrument, from the body of the musical instrument, the overall performed sound volume can increase, so that even a user not skilled in performing the musical instrument or a user incapable of performing the musical instrument with a sufficient strength can experience a good performance.

BRIEF DESCRIPTION OF DRAWINGS

Certain preferred embodiments of the present invention will hereinafter be described in detail, by way of example only, with reference to the accompanying drawings, in which.

DETAILED DESCRIPTION

Figure 1:
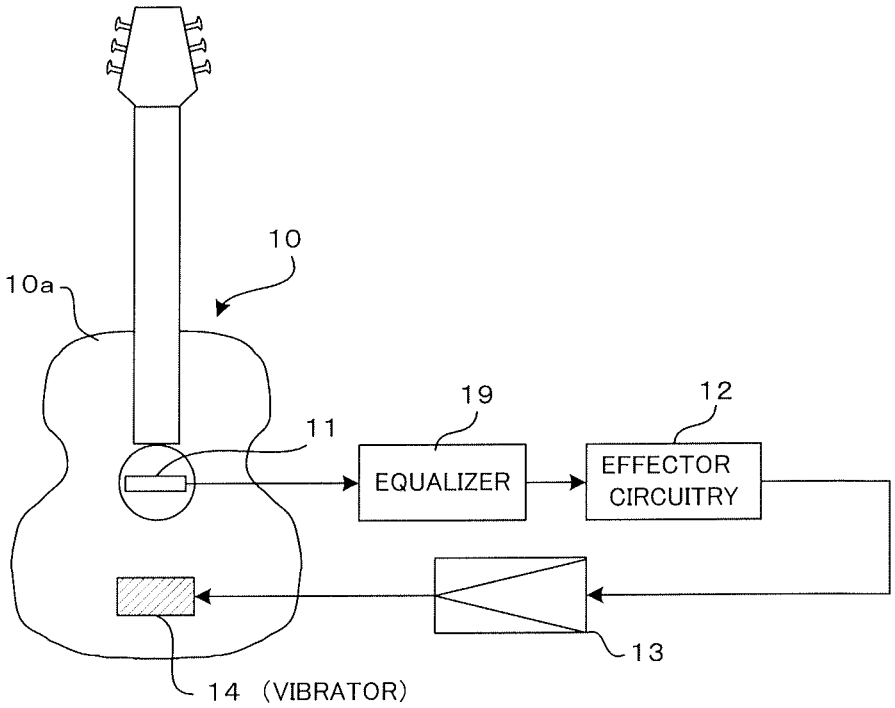
FIG. 1 is a block diagram showing an embodiment of the present invention applied to an acoustic guitar.

In an embodiment shown in FIG. 1, a musical instrument 10, which is an acoustic guitar, includes a pickup 11 for picking up vibration of a string played or performed on the musical instrument 10. An electric sound signal corresponding to a sound of the string performed on the musical instrument 10 (i.e., a performed sound of the musical instrument 10) is acquired by the pickup 11. An output of the pickup 11 is supplied to an effector circuitry 12 via an equalizer 19. By performing effect processing on the electric sound signal acquired by the pickup 11, the effector circuitry 12 generates a sound signal imparted with a musical or acoustic effect (i.e., so-called wet sound). The effector circuitry 12 may itself employs a conventionally-known effect processing circuit. The effector circuitry 12 may be constructed in such a manner that a user can select any desired type of effect from among a plurality of different types of effects, such as distortion, wah-wah, reverb and flanger, and that a degree (parameter) of the selected effect can be adjusted by a user's operation. Note that arrangements may be made for mixing, at a desired ratio, the electric sound signal generated by the pickup 11 (so-called dry sound) and the wet sound generated by the effector circuitry 12 and providing the thus-mixed sound signal as an output signal of the effector circuitry 12.

Figure 2:
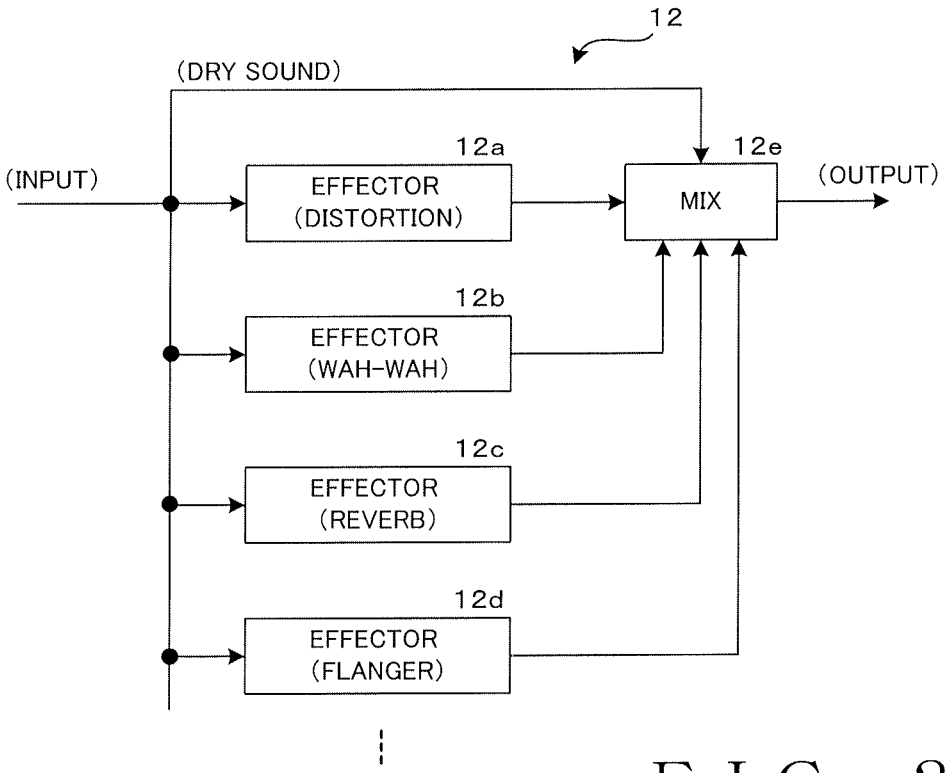
FIG. 2 is a block diagram showing an example of an internal construction of an effector circuitry shown in FIG. 1.

FIG. 2 is a block diagram showing an example of an internal construction of the effector circuitry 12. The effector circuitry 12 includes in parallel a plurality of effectors 12*a*, 12*b*, 12*c*, 12*d*, . . . for realizing respective ones of the plurality of different types of effects, such as distortion, wah-wah, reverb and flanger, and the effector circuitry 12 is constructed in such a manner that an output signal of each of the effectors 12*a*, 12*b*, 12*c*, 12*d*, . . . (wet sound) and a dry sound signal having not been subjected to the effect processing are mixed or selected at a desired ratio by means of a mix circuit 12*e*.

Each effect-imparted electric sound signal is input to a vibrator (e.g., electric-to-vibration transducer) 14 via an amplifier 13. The vibrator 14 is mounted to a suitable position of the body 10*a* of the musical instrument 10 (resonance body of the acoustic guitar) so as to generate mechanical vibration corresponding to the effect-imparted electric sound signal (wet sound) and transmit the thus-generated mechanical vibration to the body 10*a* of the musical instrument 10. As an example, the vibrator 14 may be mounted to the inner surface of the guitar body 10*a*. All the circuit elements from the effector circuitry 12 to the vibrator 14 may also be accommodated in the interior of the body 10*a*. An electric-to-vibration transducer of the conventionally-known voice coil type or any other desired type may be used as the vibrator 14.

Figure 3:
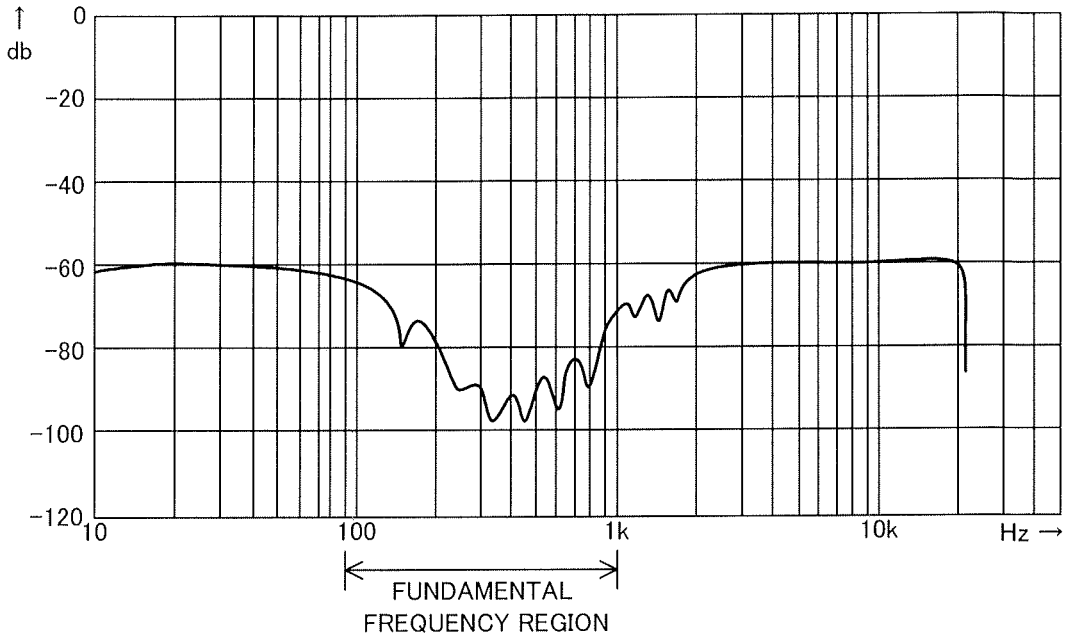
FIG. 3 is a diagram showing an example of an equalizing characteristic (i.e., a characteristic for suppressing a fundamental frequency region of the acoustic guitar) realized by an equalizer shown in FIG. 1.

The equalizer 19 is an electric circuit that adjusts a frequency characteristic of the electric sound signal, which is to be input to the vibrator 14, into a characteristic having a fundamental frequency region of the musical instrument 10 appropriately suppressed in the sound signal. As an example, the fundamental frequency region of the musical instrument 10, which is an acoustic guitar, is a range of about 80 Hz to 1 kHz, and the equalizer 19 is set at a particular equalizing characteristic to suppress such a fundamental frequency region (see FIG. 3). Namely, the frequency characteristic of the electric sound signal acquired by the pickup 11 is adjusted by the equalizer 19 so that the signal having a frequency characteristic where frequency components (harmonic components) higher than the fundamental frequency region are relatively emphasized is output from the equalizer 19 and then input to the effector circuitry 12 for subsequent effect impartment. As a consequence, the effect-imparted electric sound signal to be input to the vibrator 14 will not only have an effect characteristic imparted by the effector circuitry 12 but also have a characteristic adjusted by the equalizer 19 such that the fundamental frequency region of the musical instrument 10 is appropriately suppressed in the sound signal. The equalizer 19 may be inserted in any desired position of a signal path extending from the pickup 11 to the vibrator 14, rather than only in a position preceding the effector circuitry 12.

In the above-described construction, once the user plays or performs the musical instrument (guitar) 10 after having selected or set a desired effect and a parameter of that effect via the effector circuitry 12, a live performed sound is generated from the musical instrument (guitar) 10, and simultaneously, an electric sound signal corresponding to the thus-generated performed sound is acquired by the pickup 11. Then, the thus-acquired electric sound signal is not only adjusted by the equalizer 19 to a characteristic having the fundamental frequency region of the musical instrument 10 appropriately suppressed in the signal, but also imparted by the effector circuitry 12 with the desired effect. Then, the vibrator 14 is driven by the effect-imparted sound signal so that a mechanical vibration sound corresponding to the effect-imparted sound signal is acoustically generated from the body 10*a* of the musical instrument (guitar) 10. In this way, a mechanical vibration sound (i.e., additional vibration sound) that has the characteristic having the fundamental frequency region of the musical instrument 10 appropriately suppressed and that has been imparted with the desired effect is acoustically generated from the body 10*a* and added to the live performed sound, so that a performance feeling that has never existed before can be experienced.

Because an electric sound signal corresponding to a performed sound of the musical instrument (guitar) 10 is used as a sound source for the vibrator 14 in the instant embodiment, the embodiment requires no dedicated electronic sound source and thus can be implemented at low cost. Additionally, a mechanical vibration sound having subtleties of an actual performed sound of the musical instrument reflected therein can be generated from the body (soundboard) 10*a* of the musical instrument (guitar) 10. Moreover, because the above-mentioned mechanical vibration sound is adjusted to a characteristic having the fundamental frequency region of the musical instrument (guitar) 10 appropriately suppressed, it is possible to suppress howling occurring due to the feedback of the performed sound of the musical instrument (guitar) 10. What is more, because the additional vibration sound is generated, in addition to the performed sound of the musical instrument (guitar) 10, from the body 10*a* of the musical instrument 10, the overall performed sound volume can increase, so that even a user not skilled in performing the musical instrument (guitar) 10 or a user (such as a child) incapable of performing the musical instrument 10 with a sufficient strength can experience a good performance on the instrument 10.

Figure 4:
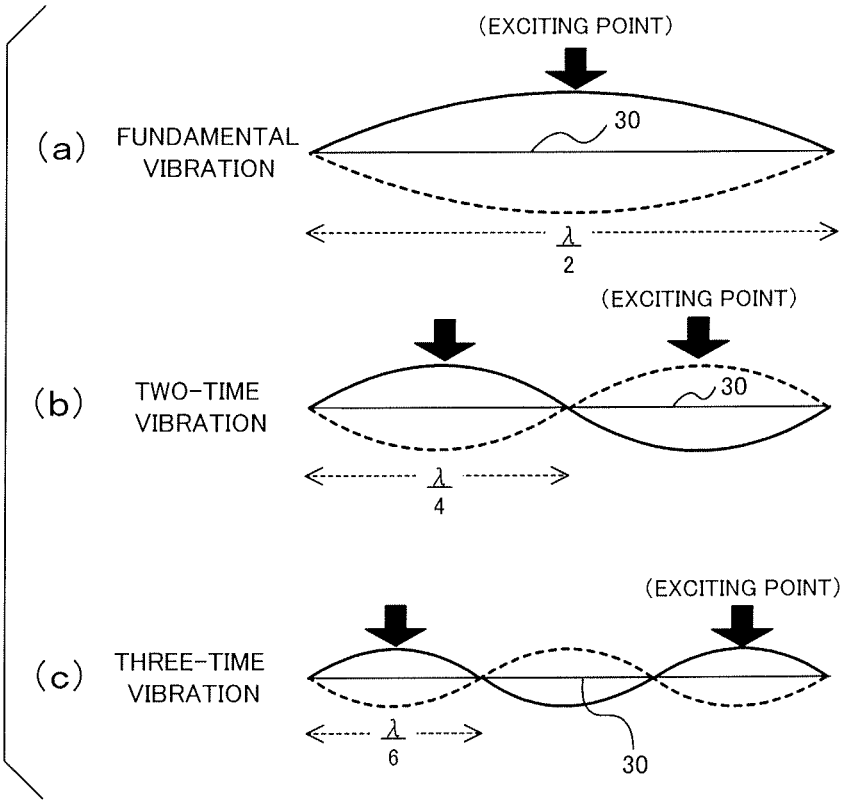
FIG. 4 is a diagram showing example physical models where mechanical vibration is depicted in a simplified form for explaining another embodiment of the present invention.

In the above-described embodiment, the aforementioned equalizer 19 functions as a transmission device constructed to transmit the mechanical vibration, produced by the vibrator 14, to the body 10*a* of the musical instrument 10 with the characteristic having the fundamental frequency region of the musical instrument 10 appropriately suppressed. In another embodiment, such a transmission device may be constructed to implement the same function as above by devising a suitable mechanical position of the vibrator 14, rather than being limited only to one including an electric circuit like the aforementioned equalizer 19. Such another embodiment will be described below with reference to FIGS. 4 and 5. FIG. 4 illustrates example physical models showing the mechanical vibration in a simplified form. More specifically, (a) of FIG. 4 is a diagram modeling mechanical vibration of a string 30, fixed at its opposite ends, when an exciting force has been applied to an anti-node of fundamental vibration of the string 30 (i.e., a ½-length position from a node (end) of the fundamental vibration, namely, a middle position of the fundamental vibration), which particularly shows generation of the fundamental vibration having a wavelength $\lambda/2$ corresponding to the length of the string 30. Further, (b) of FIG. 4 is a diagram modeling mechanical vibration of the same string 30 when an exciting force has been applied to a ¼-length position from the end (node) of the string 30, which particularly shows generation of two-time vibration having a wavelength $\lambda/4$ corresponding to one-half of the length of the string 30. Furthermore, (c) of FIG. 4 is a diagram modeling mechanical vibration of the same string 30 when an exciting force has been applied to a ⅙-length position from the end (node) of the string 30, which particularly shows generation of three-time vibration having a wavelength $\lambda/6$ corresponding to one-third of the length of the string 30. What can be seen from the physical models shown in FIG. 4 are that in the case where the exciting point is set at the anti-node (middle position) of the fundamental vibration of the vibratory member as shown in (a), mechanical vibration having higher levels of fundamental vibration components is more likely to occur, and that in the case where the exciting point is set at a position displaced from the anti-node (middle position) of the fundamental vibration of the vibratory member as shown in (b) or (c), mechanical vibration having higher levels of harmonic vibration components other than the fundamental vibration is more likely to occur. As may be understood from the foregoing, by devising a suitable mechanical position of the vibrator 14, it is possible to construct the transmission device to transmit the mechanical vibration, produced by the vibrator 14, to the body 10*a* of the musical instrument 10 with the characteristic having the fundamental frequency region of the musical instrument 10 appropriately suppressed. According to such understanding, another embodiment of the present invention may be constructed to transmit the mechanical vibration, produced by the vibrator 14, to the body 10*a* of the musical instrument 10 with the characteristic having the fundamental frequency region of the musical instrument 10 appropriately suppressed, by mounting the vibrator 14 to a position of the body (soundboard) 10*a* of the musical instrument 10 displaced from the middle of the body (soundboard) 10*a*. The aforementioned function as the transmission device may be implemented, for example, by employing a construction where the vibrator 14 is mounted to a suitable one of a plurality of positions near and along the outer peripheral edge of the body (soundboard) 10*a* of the guitar 10 as depicted by a plurality of arrows in FIG. 5. In this embodiment, the above-described equalizer 19 may be omitted or dispensed with, or both the equalizer 19 and the vibrator 14 may be used in combination without the equalizer 19 being dispensed with.

Figure 6:
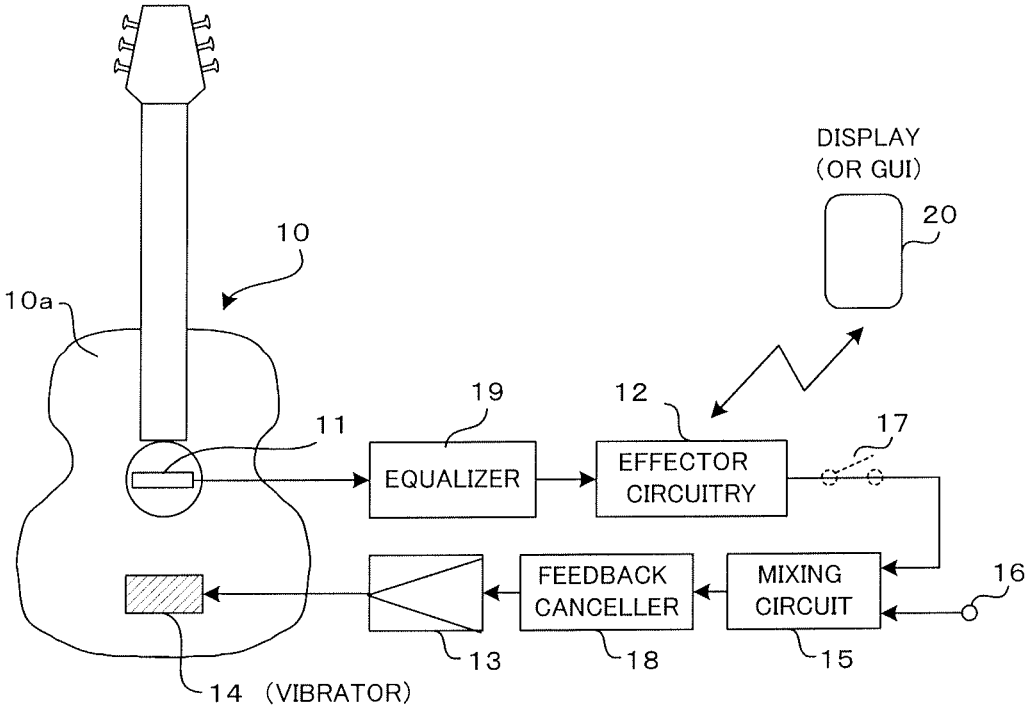
FIG. 6 is a block diagram showing various modifications of the embodiment shown in FIG. 1.

FIG. 6 shows various modifications of the embodiment shown in FIG. 1. As one modification, a mixing circuit 15 may be inserted between the effector circuitry 12 and the amplifier 13. The mixing circuit 15 mixes the output signal from the effector circuitry 12 and a desired electric sound signal from an external input terminal 16. In this way, the vibrator 14 can be driven by not only the output signal from the effector circuitry 12 but also the desired electric sound signal input from the external input terminal 16. In this case, if electric signals indicative of a melody, harmony or rhythm pertaining to a music piece to be performed on the musical instrument (guitar) 10 are input from the external input terminal 16, the user can realize an ensemble between performed sounds of the musical instrument (guitar) 10 and the melody, harmony or rhythm by means of the single musical instrument (guitar) 10. As one optional arrangement of the modification, a switch 17 may be provided between the effector circuitry 12 and the mixing circuit 15 so that turning off the switch 17 can cause the vibrator 14 to be driven by only the desired electric sound signal input from the external input terminal 16.

As another modification, a feedback canceller 18 may be inserted in a suitable position of the path extending from the pickup 11 to the vibrator 14. In this case, because a frequency characteristic to be fed back is considered to vary due to variation in characteristics resulting from usage environment and/or aging, it is preferable that a feedback canceller 18 adaptive to such frequency characteristic variation be used here. As still another modification, another equalizer (not shown) of a different type from the above-described howling-suppressing equalizer 19 may be inserted in a suitable position of the path extending from the pickup 11 to the vibrator 14. For example, in a case where the pickup 11 is constructed to pick up a sound signal after amplifying the sound signal with a characteristic that differs for each of a plurality of different pitch ranges (for each of a plurality of strings), it is preferable that the vibrator 14 be driven after pitch-range-specific amplitude characteristics are equalized by the different-type equalizer. As still another modification, equalizers of different characteristics may be inserted for respective ones of the various types of effectors as shown in FIG. 2.

As still another modification, a display 20, which may for example be a portable terminal and which is capable of communicating with the effector circuitry 12 in a wireless or wired manner, may be provided so that a type and degree of an effect currently selected in the effector circuitry 12 can be visually displayed in characters and/or graphics. As an optional arrangement of such a modification, the display 20 may be constructed to have a touch-panel type GUI (Graphical User Interface) function so that selection of an effect and adjustment/setting of a parameter of the selected effect in the effector circuitry 12 can be made via the GUI.

Figure 5:
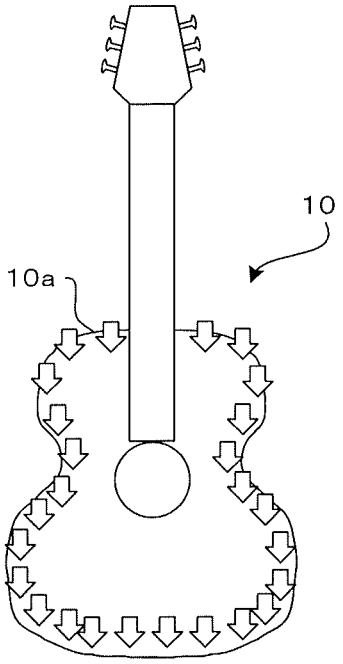
FIG. 5 is a diagram showing a disposed position of a vibrator in the other embodiment of the present invention.
Figure 7:
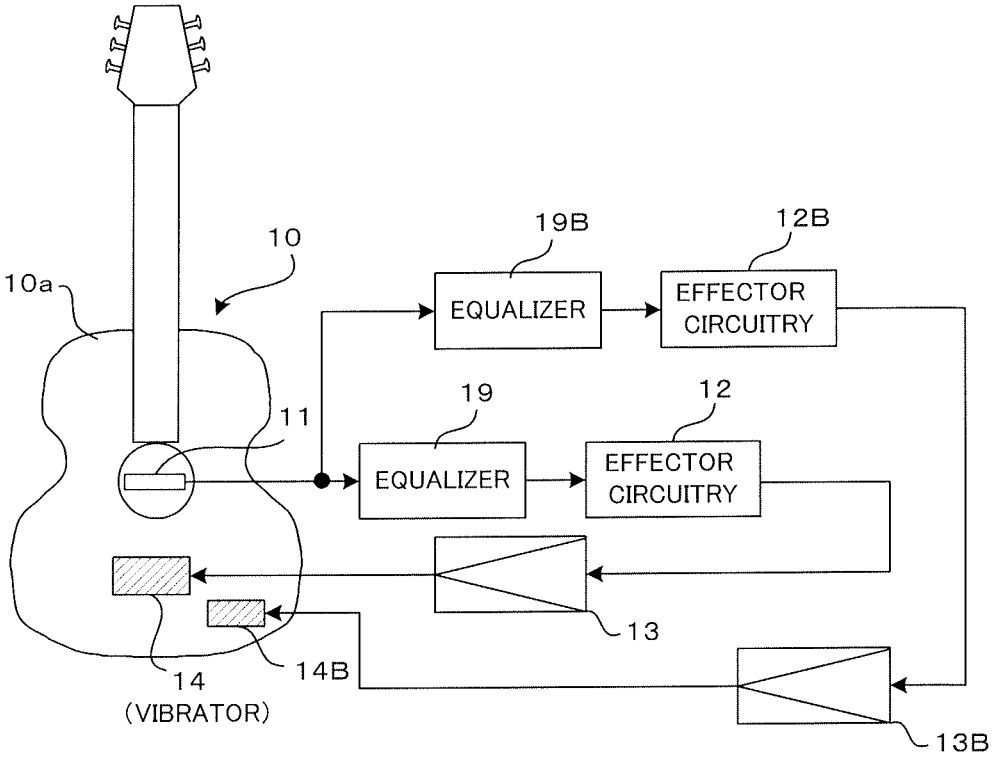
FIG. 7 is a block diagram showing another modification of the embodiment shown in FIG. 1.

FIG. 7 shows yet another modification of the embodiment shown in FIG. 1. In this modification, an additional (or second) vibrator 14B is provided on a suitable position of the body 10*a* of the musical instrument (guitar) 10 in addition to the vibrator 14 shown in FIGS. 1 to 6, and additional circuitry, including an equalizer 19B, an effector (second effector) circuitry 12B, an amplifier 13B, etc. for processing the output signal of the pickup 11, is provided in association with the second vibrator 14B. An additional vibrating element group is composed of such additional circuitry, including the second effector circuitry 12B, and the second vibrator 14B. Although the equalizer 19B and the effector circuitry 12B may be constructed similarly to the aforementioned equalizer 19 and the effector circuitry 12, they may be made different in equalizing and effect processing characteristics from those of the equalizer 19 and the effector circuitry 12. Particularly, in the case where settings of the effect processing of the second effector circuitry 12B are made different from those of the effector circuitry (first effector circuitry) 12, a vibrating characteristic different from that imparted by the main vibrator 14 can be imparted by the sub- or second vibrator 14B, so that performance effects rich in diversity can be achieved. As an alternative, the second equalizer 19B may be dispensed with, in which case the output signal of the pickup 11 may be input directly to the second effector circuitry 12B, or the output from the equalizer 19 may be input to the second effector circuitry 12B. Further, a mixing circuit and/or a feedback canceller similar to the mixing circuit 15 and/or the feedback canceller 18 shown in FIG. 6 may be inserted in a suitable position of the additional circuitry from the second effector circuitry 12B to the second vibrator 14B. Further, a sub-pickup (not shown), separate from the main pickup 11, may be provided on the musical instrument (guitar) 10 so that an output signal of this sub-pickup is input to the additional circuitry, i.e. to the second vibrator 14B via the second effector circuitry 12B. Note that the disposed position, on the body 10*a* of the musical instrument (guitar) 10, of the second vibrator 14B need not necessarily be such a position (as shown in FIG. 5) that permits suppression of the fundamental frequency region of the musical instrument 10. Furthermore, whereas only one additional vibrating element group including the second effector circuitry 12B, second vibrator 14B, etc. has been described above, two or more such additional vibrating element groups may be provided.

According to the present invention, only one of the above-described modifications may be employed, or two or more of the above-described modifications may be employed in combination. Further, the circuit elements constituting the above-described embodiments and modifications of the present invention may be implemented by dedicated discrete circuits, IC (Integrated Circuit) or LSI (Large-Scale Integrated circuit), DSP (Digital Signal Processor) and/or the like, and some or all of the functions, which are capable of being processed by use of a computer or a processor unit (CPU), may be implemented by a computer or a processor unit. In the case where a computer or a processor unit is used, there are also provided a memory storing programs for performing at least some of the functions in the above-described embodiments and modifications of the present invention, as well as a data storing or working memory.

The application of the present invention is not limited to the above-described acoustic guitar, and it is applicable to, of course, other stringed instruments like ukuleles, basses, violins and cellos, and to various other types of musical instruments having a resonance body, such as wind instruments, percussion instruments and pianos. Also, the present invention is applicable to not only natural musical instruments but also electronic musical instruments having an electronic sound source. Further, the pickup 11 may be constructed in any desired manner as long as it is constructed to acquire an electronic sound signal corresponding to a sound performed on the musical instrument, and any one of an electromagnetic type pickup, piezoelectric type pickup, small-size microphone, etc. may be used as the pickup 11 depending on the type of the musical instrument to which it is applied.

What is claimed is:

1. A musical instrument comprising:

a pickup that acquires an electric sound signal corresponding to a performed sound of the musical instrument;

an effector circuitry that imparts an effect to the electric sound signal acquired by the pickup; and a vibrator mounted to a body of the musical instrument for producing mechanical vibration corresponding to the sound signal imparted with the effect, wherein the mechanical vibration, produced by the vibrator, is caused to be transmitted to the body of the musical instrument with a frequency characteristic having a fundamental frequency region of the musical instrument suppressed so as to suppress feedback of the performed sound of the musical instrument.

2. The musical instrument as claimed in claim 1, wherein the mechanical vibration, produced by the vibrator, is caused to be transmitted to the body of the musical instrument with the frequency characteristic having the fundamental frequency region of the musical instrument suppressed by a transmission device including an electric circuit adjusts a frequency characteristic of the sound signal to be input to the vibrator to the frequency characteristic having the fundamental frequency region of the musical instrument suppressed.

3. The musical instrument as claimed in claim 2, wherein the electric circuit is an equalizer.

4. The musical instrument as claimed in claim 1, wherein the vibrator is mounted to the body of the musical instrument at such a position so as to cause the mechanical vibration, produced by the vibrator, to be transmitted to the body of the musical instrument with the frequency characteristic having the fundamental frequency region of the musical instrument suppressed.

5. The musical instrument as claimed in claim 4, wherein the body of the musical instrument is a resonance body, and wherein the vibrator is mounted to the resonance body at a position displaced from an anti-node of fundamental vibration of the resonance body.

6. The musical instrument as claimed in claim 1, further comprising a mixing circuit that mixes an output signal from the effector circuitry and an electric audio signal supplied from an external input terminal, wherein the mechanical vibration produced by the vibrator corresponds to an output signal of the mixing circuit.

7. The musical instrument as claimed in claim 1, further comprising:

a second effector circuitry that imparts an effect to the electric sound signal acquired by the pickup; and a second vibrator mounted to the body of the musical instrument for producing mechanical vibration corresponding to the sound signal imparted with the effect by the second effector circuitry.

8. The musical instrument as claimed in claim 7, further comprising a second transmission device constructed to transmit the mechanical vibration, produced by the second vibrator, to the body of the musical instrument with the frequency characteristic having the fundamental frequency region of the musical instrument suppressed.

9. A method comprising:

acquiring, via a pickup, an electric sound signal corresponding to a performed sound of a musical instrument;

imparting, via an effector circuitry, an effect to the acquired electric sound signal;

producing, by a vibrator mounted to a body of the musical instrument, mechanical vibration corresponding to the sound signal imparted with the effect; and transmitting the mechanical vibration, produced by the vibrator, to the body of the musical instrument with a frequency characteristic having a fundamental frequency region of the musical instrument suppressed so as to suppress feedback of the performed sound of the musical instrument.

10. The method as claimed in claim 9, wherein transmitting the mechanical vibration to the body of the musical instrument with the frequency characteristic having the fundamental frequency region of the musical instrument suppressed includes adjusting, via an electric circuit, a frequency characteristic of the sound signal to be input to the vibrator to the frequency characteristic having the fundamental frequency region of the musical instrument suppressed.

11. The method as claimed in claim 10, wherein the electric circuit is an equalizer.

12. The method as claimed in claim 9, wherein the vibrator is mounted to the body of the musical instrument at such a position so as to cause the mechanical vibration, produced by the vibrator, to be transmitted to the body of the musical instrument with the frequency characteristic having the fundamental frequency region of the musical instrument suppressed.

13. The method as claimed in claim 12, wherein the body of the musical instrument is a resonance body, and wherein the vibrator is mounted to the resonance body at a position displaced from an anti-node of fundamental vibration of the resonance body.

14. The method as claimed in claim 9, further comprising mixing, by a mixing circuit, an output signal from the effector circuitry and an electric audio signal supplied from an external input terminal, wherein the mechanical vibration produced by the vibrator corresponds to an output signal of the mixing circuit.

15. The method as claimed in claim 9, further comprising:

imparting, via a second effector circuitry, an effect to the electric sound signal acquired by the pickup; and producing, via a second vibrator mounted to the body of the musical instrument, mechanical vibration corresponding to the sound signal imparted with the effect by the second effector circuitry.

16. The method as claimed in claim 15, further comprising transmitting the mechanical vibration, produced by the second vibrator, to the body of the musical instrument with the frequency characteristic having the fundamental frequency region of the musical instrument suppressed.

* * * * *